US005453041A

United States Patent [19]

Oliver

[11] Patent Number: 5,453,041

[45] Date of Patent: Sep. 26, 1995

[54] CUTTING EDGE TEETH AND THEIR ORIENTATION ON TOOLS USED TO SHAPE AND TEXTURE THE SURFACES OF NON-METALLIC AND COMPOSITE MATERIALS

[76] Inventor: Lloyd R. Oliver, 9974 Dixie Hwy., Ira, Mich. 48023

[21] Appl. No.: 164,956

[22] Filed: Dec. 10, 1993

[51] Int. Cl.[6] ..... B23F 21/03

[52] U.S. Cl. ..... 451/541; 76/112

[58] Field of Search ..... 51/204, 206 R, 51/206 P, 206.4, 207, 209 R; 125/13.01, 22; 83/663, 678, 669, 332; 451/540, 541, 547, 542, 544, 548

[56] References Cited

U.S. PATENT DOCUMENTS

| | | | |
|---|---|---|---|
| 3,162,187 | 12/1964 | Christensen | 76/112 |
| 3,956,956 | 5/1976 | Bertholf | 83/678 |
| 4,854,295 | 8/1989 | Sakarcan | 51/206 P |
| 5,018,276 | 5/1991 | Asada | 76/115 |

FOREIGN PATENT DOCUMENTS

| | | | |
|---|---|---|---|
| 232825 | 4/1964 | Austria | 76/112 |
| 84774 | 4/1958 | Denmark | 76/112 |
| 1049435 | 7/1951 | France | 76/112 |
| 235080 | 11/1944 | Switzerland | 76/112 |
| 288222 | 1/1953 | Switzerland | 76/112 |

*Primary Examiner*—Bruce M. Kisliuk
*Assistant Examiner*—Derris H. Banks
*Attorney, Agent, or Firm*—Spencer, Frank & Schneider

[57] ABSTRACT

A cutting tool has cutting teeth attached to a base surface of the cutting tool. Each tooth is provided with a generally vertical leading face that is arranged at an angle relative to a forward stroke direction of the cutting tool, and a corresponding, similarly shaped trailing face relative to said forward stroke direction. Extending between the leading face and the trailing face is at least one cutting surface perpendicular to the leading face. The cutting surface has an elongated, generally linear crest having a length that extends between the leading and trailing faces and is situated at a distance from the base surface. Each leading face forms a piercing corner with the crest. The teeth of the cutting tool are arranged in a plurality of rows, with each row being oriented generally perpendicularly to the forward stroke direction. Each leading face of each tooth of at least one row is oriented at an angle relative to the forward stroke direction.

132 Claims, 4 Drawing Sheets

CUTTING EDGE TEETH AND THEIR ORIENTATION ON TOOLS USED TO SHAPE AND TEXTURE THE SURFACES OF NON-METALLIC AND COMPOSITE MATERIALS

BACKGROUND OF THE INVENTION

The present invention relates primarily to the design and use of cutting and abrading tools and particularly to the shape of the cutting teeth and their edge orientation on the base surface of the tool.

Presently, the base surface of many cutting tools designed and in use for machining, abrading and texturing of elastomers and other non-metallic and composite materials are covered with either various non-oriented hard, abrasive, mono-layered grits, or with solid or structured conical or pyramidal points. For example, U.S. Pat. No. 3,918,217 describes various means to magnetically structure grits of various kinds into conical shaped teeth. U.S. Pat. No. 4,916,869 describes molding of grits into various pyramidal, conical and other shaped armorings made by the use of molds made from models.

Sharp, acute-angled conical or pyramidal tooth points as are known are weak and tend to break off easily or wear away too rapidly. Thus, tool life is relatively short. Further, as the peaks of these teeth become worn, the resultant work piece surface texture changes and eventually becomes unacceptable. Moreover, these pointed tooth designs tend to leave grooved patterns on and into the work pieces; hence the teeth must be truncated by dressing to a common cutting circle, configuration or plane to reduce the inherent grooving. However, truncation increases the truncated width of the tooth which greatly increases friction-caused heat.

Additionally, all such pointed tooth shapes inherently cause a great increase in friction-caused heat because of the rubbing of the rake surfaces against the work piece which is not cut away by the tooth point or truncated edge. This friction-caused heat causes smoke and scorching to the work piece. The adverse affects of the friction-caused heat becomes increasingly severe when mechanically working plastics, all elastomers and other like hydrocarbon materials and composites thereof which are resilient and inherently more sensitive to heat.

Monolayered grits and patterns of such grits usually have inherent truncated, generally obtuse-angled teeth and edges. While stronger and more wear-resistant, these edges cause even greater amounts of friction, and increased energy is used and wasted as frictional heat to the tool and to the work piece. This often tends to scorch or burn the work piece surface and produces objectionable smoke and other undesirable effects to the work pieces such as scorch to elastomers.

Extensive evaluations have been made of the aforementioned limitations of monolayered grits bonded with resin, vitreous, or metal bonds, as well as the limitations inherent to the structured pointed teeth of U.S. Pat. No. 3,918,217 and U.S. Pat. No. 4,916,869, and all other such similar pointed tooth forms such as is disclosed, for example, in U.S. Pat. Nos. 4,460,382, 1,988,065, 3,906,684, 4,539,017, 5,015,266, 5,054,246, 5,064,445, 5,066,312, 5,107,626, 5,152,917, 4,779,386, 4,918,874, 4,776,862, 5,131,924, 5,133,782 and 4,278,448. These studies led to the discovery of the present invention which uses fewer molded, wrought or cast teeth having wider and preferably overlapping edges for the purpose of mechanically working rubbers, elastomers and other non-metallic and hydrocarbon materials and composites thereof, and to cause predetermined surface textures.

The present invention considers the use of any and all hard, natural and man-made grits and particles bonded to each other with resins, vitreous materials or braze metals in the described raised shapes that are not monolayered. The bonding agent usually is used for both bonding of the molded structures as well as bonding the structures to the carriers, resulting in an armed tool. The present invention anticipates that the teeth can also be made of materials used in powder metallurgy and by forming from wrought and cast metals.

SUMMARY OF THE INVENTION

It is an object of the present invention to avoid the above-mentioned drawbacks by providing a novel tooth form which is stronger and more wear resistant than related prior art tooth designs.

It is yet another object of the invention to use tooth shapes which are easily molded and released from molds, while providing for a tooth shape that can be applied to a base body with adequate cost effectiveness.

It is a further object of the present invention to provide a cutting tool with an improved cutting tooth arrangement so that work piece material can be aggressively removed resulting in a smooth and precise cut with a minimal amount of clogging and heat build-up.

The above and other objects are accomplished according to the invention by the provision of attaching a plurality of teeth to a base surface of the cutting tool. Each tooth is provided with a generally vertical leading face that is arranged at an angle relative to the forward stroke direction of the cutting tool, and a corresponding, similarly shaped trailing face relative to said forward stroke direction. Extending between the leading face and the trailing face is a cutting surface or surfaces perpendicular to the leading face. The cutting surface or surfaces have an elongated, generally linear crest having a length that extends between the leading and trailing faces and is situated at a distance from the base surface. Each leading face forms a piercing corner with the crest.

The teeth of the cutting tool are arranged in a plurality of rows, with each row being oriented generally perpendicularly to the forward stroke direction. Each leading face of each tooth of at least one row is oriented at an angle relative to the forward stroke direction.

The novel tooth form of the present invention is a radical departure from tooth shapes employed in present-day abrasive tools and cutting edge tool designs. Rather than being pointed, conical or pyramidal, the teeth of the present invention have elongated raised edges at the tooth crests which are stronger and more wear-resistant than in related prior art tooth designs, and are made to work at a common plane, circle or predetermined surface configuration.

The elongated raised edges of the present invention terminate in vertical ends or faces which form sharp, piercing corners with the top of the tooth crest. This results in sharp, substantially zero raked faces at the piercing corners, with an additional shearing edge extending from the piercing corner to the base of the tooth. Piercing into the work piece to any depth of cut is easily accomplished, and allows the trailing portion of the elongated raised edge or land to shear away wider cuttings as compared to the rubbing of the conical tooth surfaces below the tip or truncation of the conical points of the prior art.

Fewer teeth are required with the present invention resulting in savings in the cost of expensive grit and binder substances, such as diamond and other like hardness materials.

The teeth of the invention can be oriented to provide a wider cut and shearing effect for ease of penetration and subsequent cuttings removal width, rather than the scratching effects of pointed teeth of the prior art. Further, the teeth can be arranged in edge orientations and patterns to more appropriately suit the machining requirements peculiar to various work piece materials. The spacing and pitch of the teeth can be controlled to cause minimum frictional heat and to provide for chip clearance and to influence tooth edge penetration.

The materials from which the teeth of the present invention are made from and the methods by which they are manufactured are not within the scope of this invention, nor is the method of attachment of such teeth to a cutting tool working surface. Some materials and manufacturing methods are adequately covered and discussed by U.S. Pat. Nos. 3,918,217 and 4,916,869 and other means, and with very little modification may be employed in the construction of the improved tooth shape under the present invention.

The geometry of this invention's improved tooth shape conforms to the following principles:

The crest of each tooth is substantially in a straight line and has an elongated raised edge having typically a sharp apex or a narrow truncation, from a preferred included apex angle of less than 90 degrees to about 30 degrees minimum. The preferred apex angle is approximately 45 degrees. The elongated edge of the tooth may also be truncated, rounded or serrated. The elongated edge may also have partially exposed diamond-like hard grits bonded in the apex according to U.S. Pat. No. 4,916,869.

The leading and trailing faces of the teeth must be alike or of complimentary shape so that when viewed from opposite ends the contours are identical. Further, the leading and trailing faces may have vertical, positive or negative raked angles.

The preferred lateral cross-section of a tooth is normally isometric in character, however, pairs of teeth may have complimentary shapes and for purposes of this description will be considered to be parts of a single tooth.

The orientation of the teeth on a cutting tool will be with the leading face of each tooth angled forward to the direction of tool movement so that as the tool advances, the leading end piercing corner of each tooth starts a cut and a skewed cutting edge or side of the tooth then continues to shear a commensurately wide chip from the surface of a work piece. The preferred angle of shearing is about 45 degrees or more to the direction of forward movement, to some angle up to but less than 90 degrees from tangent to forward movement.

Patterns of teeth may be made wherein some teeth alternately shear to the right followed by others shearing to the left, relative to the forward movement or axial rotation of the tool. Usually the action of the tool as a whole will be the same whether used in a forward or reverse direction when the tooth apex angle is evenly (i.e. symmetrically) angled from its apex edge to the tooth base.

The pitch between the trailing face of a tooth and the leading face of a following tooth forms a gullet which allows the initial penetration of each tooth to ease into the work piece material as the tool advances. Spacing between adjacent teeth, which also provides for penetration, chip clearance and cooling, will be close enough or staggered so that material not removed by one set of teeth will be removed by a subsequent following tooth or set of teeth.

One preferred objective of the invention is to use tooth shapes which are easily molded and released from molds while providing for a tooth shape that can be applied with adequate cost effectiveness. For these reasons, an isometric tooth shape having a 45 degree included edge apex angle with the vertical ends is preferred which will yield a zero degree end rake when armored to a wheel or plane operating face. This zero degree end rake and the leading truncated edge or edge corner also contributes to leading end piercing corner penetration and optimum and adequate shearing of many materials anticipated to be worked by this invention.

The shearing edge and the leading tooth face may each have a rake of zero degrees, with the trailing face or back of the tooth having an acute clearance angle from the apex edge of about 45 degrees. Here too, the included angle of the edge apex is about 45 degrees. In all embodiments, the vertical rakes and positive raked leading piercing corner and edge faces are oriented toward the direction of working of the material.

Both ends of the teeth may have a positive rake to enhance penetration, or alternatively, only the leading end face may be angled to a positive rake.

Preferably the height of the tooth is about equal to or less than the length of the edge. The molded and operational spacing between the edges parallel to a common line (i.e., the distance between adjacent tooth rows) is about one half the length of the tooth edges. The molded spacing or pitch between each adjacent tooth is preferably equal to the length of the teeth. Typically, each tooth cutting edge is arranged to be parallel to a corresponding adjacent tooth cutting edge so that when the teeth are applied to the tool body the parallel rows of teeth are mounted at about 45 degrees or more to the intended movement of the tool to the work piece. This provides for efficient shearing efficiency and the following rows of tooth cutting edges catch the material left by any of the preceding teeth's spaces and easily clears all the cuttings from the teeth and tool face.

Also noteworthy is the strength and shock resistance of the tooth form and edge of this invention. This is due to the increased amount of tooth material which supports the ends and corners of the edges when angled to the direction of movement of the tool. Again, this preferred angle of shearing is 45 or more degrees but not parallel to the direction of movement unless used for grooving purposes.

The teeth may have more length of edge at a shearing angle and a wider pitch of teeth to secure penetration to a depth of cut with greater ease and use of fewer teeth than allowed by prior art grits or conical tooth points. This results in less friction caused heat and a reduced power consumption.

Cutting and abrading tools employing this novel tooth armoring can be of any shape or construction. They may be designed to be used in either a reciprocating, rotating or oscillating motion or combinations thereof. Some may be designed to operate in a single or reversible direction.

The invention will be described below in greater detail in connection with embodiments thereof that are illustrated in the drawing figures.

DETAILED DESCRIPTION OF THE PREFERRED EMBODIMENT

Figure 1:
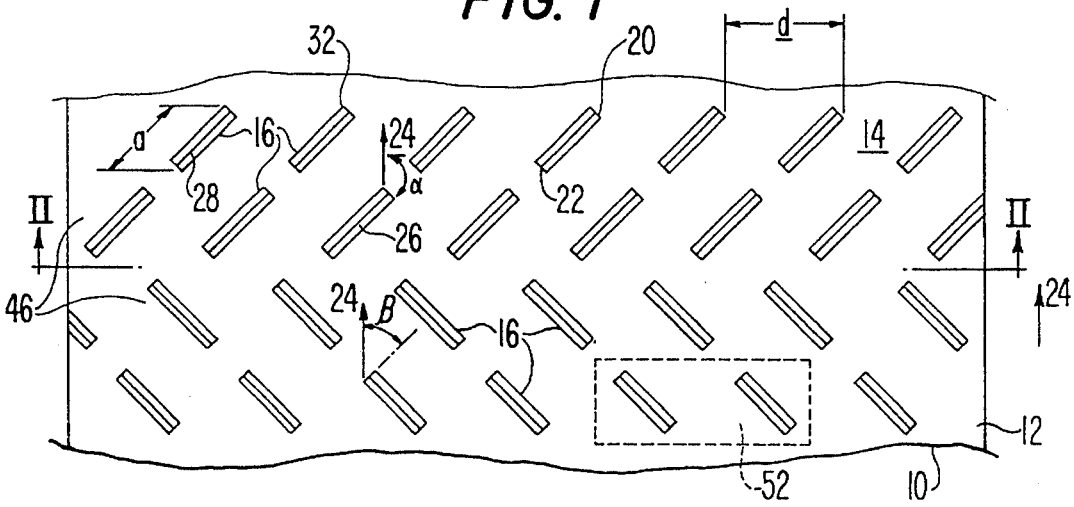
FIG. 1 is a fragmentary top plan view of a preferred embodiment of the present invention.
Figure 2:
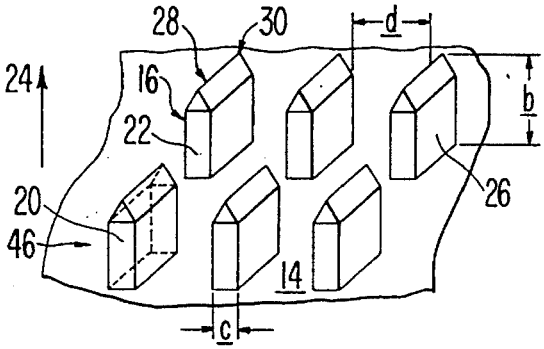
FIG. 2 is a fragmentary perspective illustration of the preferred embodiment as viewed along line II—II of FIG. 1.
Figure 3:
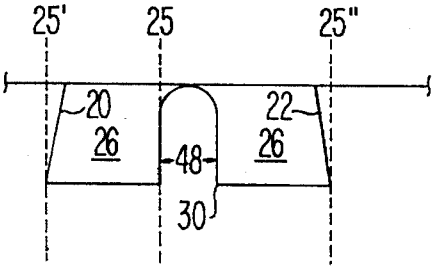
FIG. 3 is a fragmentary side elevational view of the preferred embodiment.

Referring to FIGS. 1–3, a cutting tool 10 has a base body 12. The base body 12 has a base surface 14 to which teeth 16 are attached. Each tooth 16 has a generally perpendicular leading face 20 relative to base surface 14 and a similarly shaped trailing face 22 relative to the forward stroke direction 24.

Leading face 20 and trailing face 22 may have a zero rake 25. Such a rake will tend to increase the chip curl as the chip is generated, and will tend to break up the chip into smaller, safer pieces. Thus, the chips will not become entangled or clogged within cutting tool 10. Alternatively, leading face 20 may be provided with a positive rake 25' to enhance penetration into a work piece, and trailing face 22 provided with a negative rake 25" to reduce frictional heat and chip loading. Other variations are also possible without departing from the spirit and scope of the present invention.

Leading face 20 is arranged at an angle $\beta$ relative to forward stroke direction 24. Angle $\beta$ is typically between about 15 to about 90 degrees, and is preferably about 45 degrees. Further, at least one cutting surface 26 is arranged perpendicularly to leading face 20 and extending between the leading face 20 and the trailing face 22. Cutting surface 26 may be provided with a zero to positive rake, depending upon the particular configuration of the tooth as will be discussed.

Each tooth further has an elongated, generally linear tooth crest 28. Tooth crest 28 is typically parallel to base surface 14. Each tooth crest has a length a extending between leading face 20 and trailing face 22 and which corresponds to the length of the cutting surface 26. Length a is typically about one eighth inch. The distance between tooth crest 28 and base surface 14 defines a height b, typically about two-thirds of length a. In order to ensure a smooth, even cut from the work piece, each tooth 16 has essentially the same tooth height b. Thus, the teeth are designed to work at a common plane, circle, or predetermined base surface configuration.

Additionally, each tooth has a base width c relative to base surface 14. Length a is greater than base width c so that as tooth 16 becomes worn due to use, it can be dressed and truncated to reproduce an efficient shearing edge.

Each leading face 20 forms a piercing corner 30 with crest 28. Extending from piercing corner 30 to base surface 14 is a shearing edge 32. During operation, piercing corner 30 readily initiates a pierce into the work piece followed by shearing edge 32, allowing for a depth of cut into the work piece equal to tooth height b.

Referring to FIGS. 4–7, each crest 28 has an upper edge 34 relative to base surface 14. Upper edge 34 can be formed in the shape of an angle a being between 30 and 90 degrees, and is typically about 45 degrees. Alternatively, upper edge 34 may form a planar surface 36 that is parallel to base surface 14, or a convex surface 38 relative to base surface 14. Upper edge 34 may further be comprised of partially exposed bonded grits 40 having up to a diamond-like hardness, providing increased wearability to tooth 16. Each grit 40 would be bonded to tooth 16 up to crest 28 in a brazed matrix, whereby about one-half of each grit at upper edge 34 is exposed. As upper edge 34 wears, new grits 40 within the matrix become exposed. Additionally, upper edge 34 may be a serrated surface 42.

Figure 8:
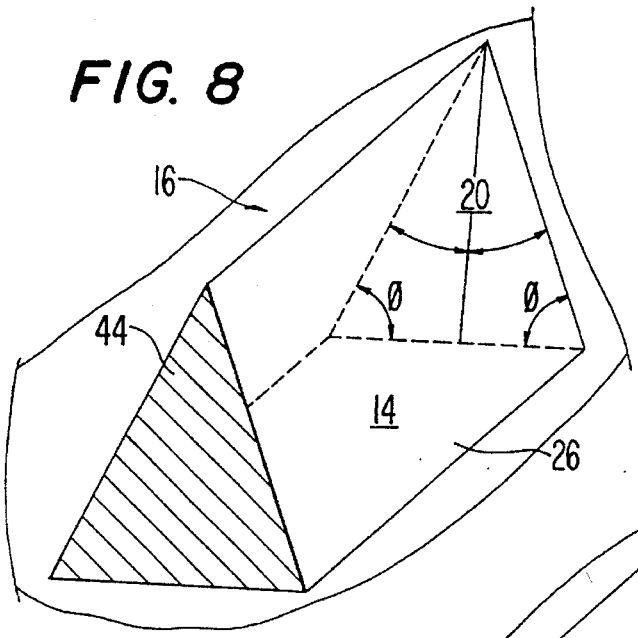
FIG. 8 is a cross-sectional perspective illustration of a tooth of the present invention.
Figure 9:
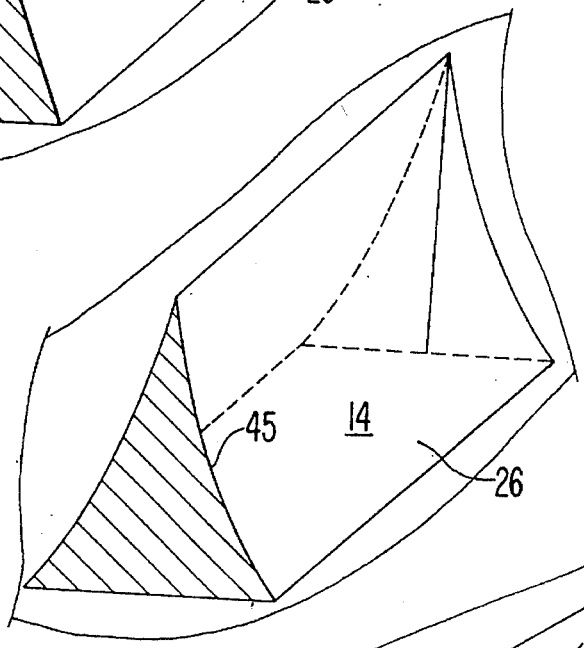
FIG. 9 is across-sectional perspective illustration of an alternative embodiment of a tooth of the present invention.
Figure 10:
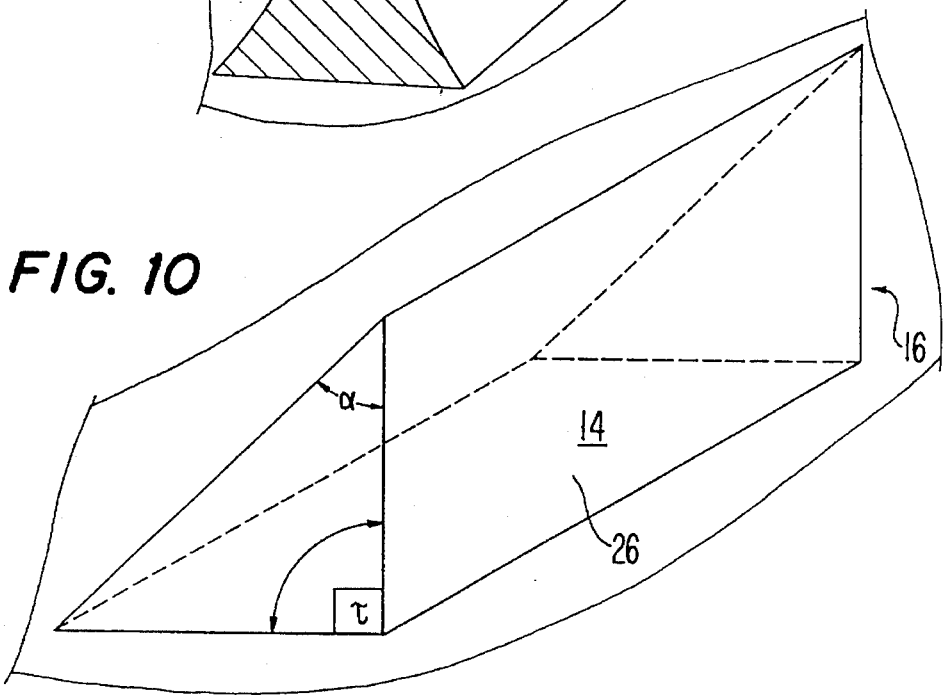
FIG. 10 is a perspective illustration of an alternative embodiment of a tooth of the present invention.
Figure 11:
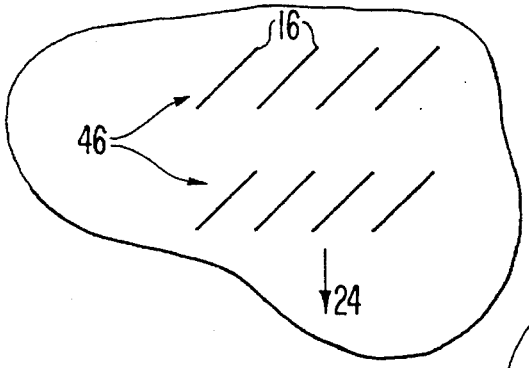
FIGS. 11–14 are various alternate top plan views of the teeth and row orientations of the present invention.
Figure 12:
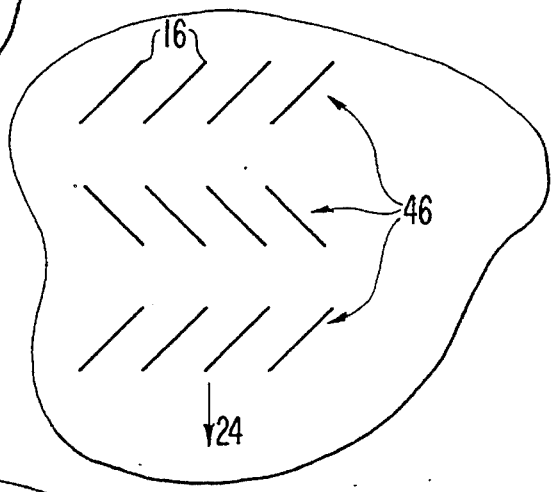
Figure 13:
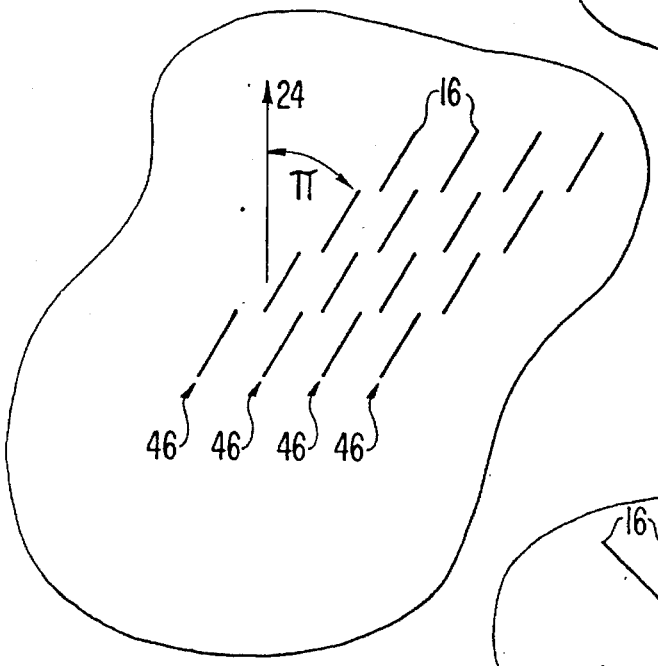
Figure 14:
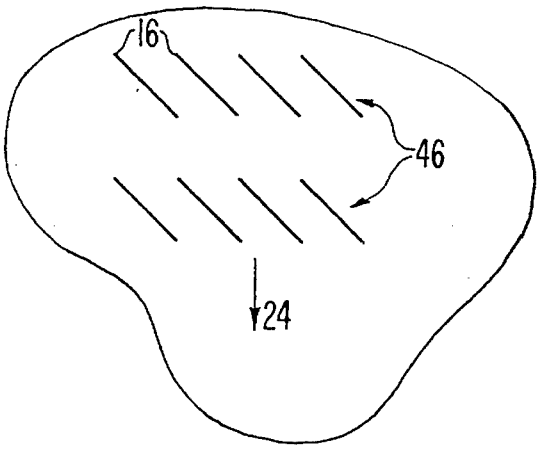

Referring to FIGS. 8–10, tooth 16 has a generally triangular cross section 44 corresponding in shape to leading face 20 and taken perpendicular to cutting surface 26, although other shapes may be used. For example, tooth 16 may be designed as having a trapezoidal or rectangular cross section. Further, cutting surface 26 may be concave, so that the cross section has an arcuate edge 45.

Typically, triangular cross section 44 is an isosceles triangle, where the two equal angles $\phi$ are formed at the base surface. Alternatively, the triangular cross section may be a right angle triangle, where the right angle $\tau$ is formed between cutting surface 26 and base surface 14.

Preferably, each tooth 16 is of symmetrical design such that when the cutting tool is operated in a reverse stroke direction, a chip is generated in the same manner as in a forward operation. When the tool stroke direction is reversed, trailing face 22 becomes the leading face. This effectively doubles the cutting life of the cutting tool. Further, should the cutting tool become clogged during operation, reversing the forward stroke direction will result in a removal of any material loading the cutting surface. Alternatively, tooth 16 may be designed to operate in only a forward stroke direction, for example, when a symmetrical tooth design is not possible or desired.

Referring back to FIGS. 1 and 3, and to FIGS. 11–14, teeth 16 are arranged in a plurality of rows 46. Each tooth 16 of any row 46 is separated from an adjacent tooth within the same row by a tooth space d. Tooth space d is of sufficient size to allow each chip generated to be discharged or dislodged from cutting tool 10 during operation so as to minimize or eliminate loading or clogging of cutting tool 10, and is typically about equal to or greater than crest length a.

Each row 46 may be oriented generally perpendicular to forward stroke direction 24, and parallel to an adjacent row. Alternatively, rows 46 may be oriented at an angle $\pi$ relative to forward stroke direction 24. Angle $\pi$ is generally between about 45 and 90 degrees.

As mentioned, teeth 16 of at least one adjacent row 46 have leading faces 20 that form acute angles $\beta$ with forward stroke direction 24. Rows 46 may be alternated so that teeth 16 of at least one adjacent row 46 have leading faces 20 that form acute angles $\beta$ with forward stroke direction 24, and teeth 16 of at least one consecutive adjacent row 46 have leading faces 20 that form obtuse angles $\alpha$ with the forward stroke direction 24. Each obtuse angle a is generally between 105 to about 165 degrees with respect to forward stroke direction 24, and is typically about 135 degrees. Preferably, all teeth of any one row are similarly arranged and evenly spaced, with each cutting surface 26 being essentially parallel and arranged at the same angle as the cutting surface of an adjacent tooth. Rows 46 may be alternated in pairs, or in any other conceivable configuration. By alternating the rows, clogging or loading of the spaces between the teeth and the rows is minimized, resulting in minimal heat build-up and optimal cutting efficiency.

Each row 46 is separated from an adjacent row by a gullet 48 which allows piercing corner 30 to initiate the penetration into the work piece. Gullet 48 is typically about equal to or greater than crest length a.

In the preferred embodiment, each tooth 16 of any row 46 is offset relative to the teeth of an adjacent row as viewed parallel to the forward stroke direction 24. Stated differently, cutting surface 26 of a row is located in alignment with a respective tooth space d of the preceding row as viewed in the forward stroke direction 24. In this manner, any material not removed by a pass of cutting tool 10 through the work piece due to tooth space d will be removed by the offset teeth of the adjacent row.

During operation, when material is desired to be removed from a work piece, cutting tool 10 is operated in forward stroke direction 24. For each tooth 16 its piercing corner 30 arrives into contact with the work piece first, penetrating into the work piece and initiating the generation of a chip. Cutting surface 26, after the initial penetration has taken place, shears a swath into, and a chip from the work piece.

Figure 15:
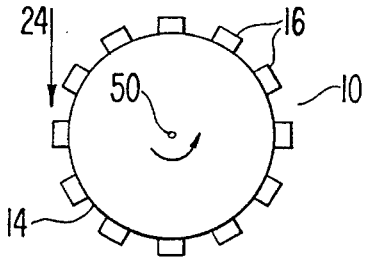
FIG. 15 is a side elevational view illustration of the present invention.
Figure 4:
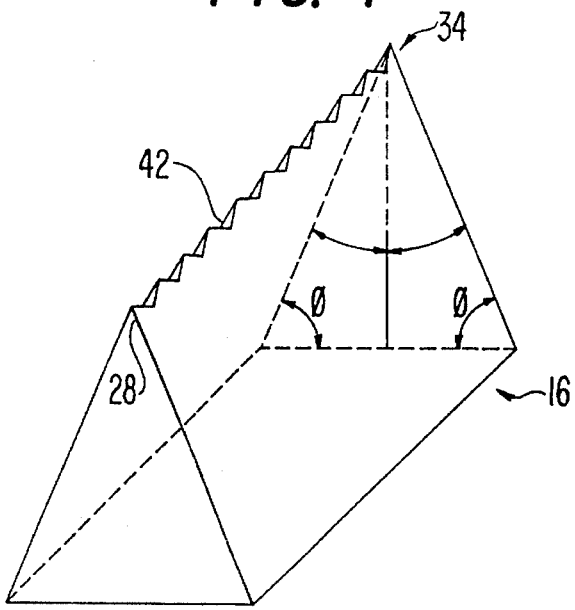
FIGS. 4–7 are various alternate perspective illustrations of a tooth of the present invention.
Figure 5:
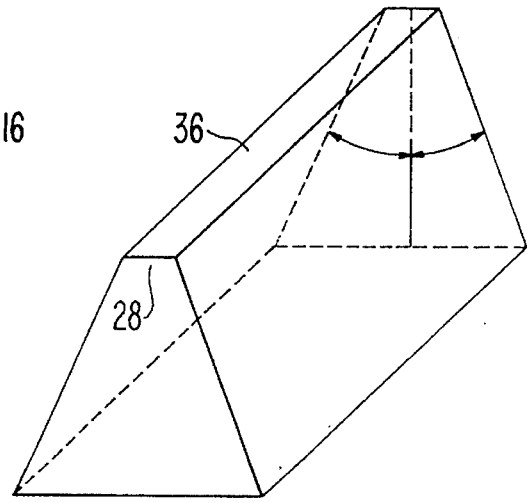
Figure 6:
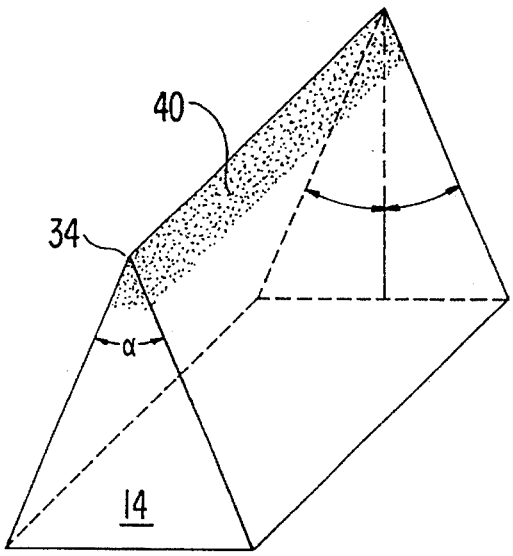
Figure 7:
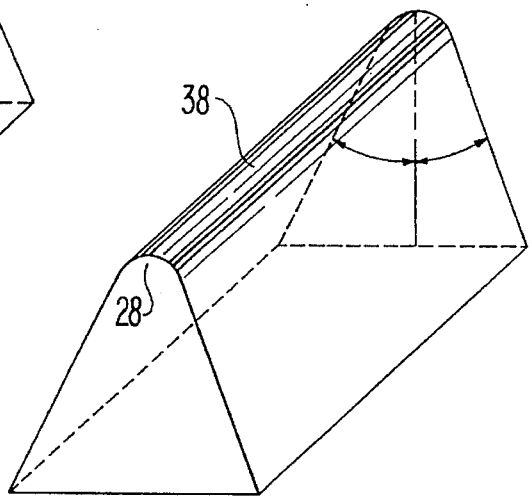

Referring to FIG. 15, the base surface 14 of the cutting tool 10 is shown having an essentially cylindrical shape. During operation the cutting tool 10 is rotated, for example by a rotary chuck of a machine, about the central axis 50 of the cutting tool, in which case the forward stroke direction 24 is perpendicular to the axis 50 and is parallel to the tangent of the cylindrical base surface 14 at the location where the tool engages the work piece. Each tooth 16 can make numerous cuts upon the work piece with every pass of the tool, thus more efficiently removing material from the work piece than a cutting tool having a non-cylindrical shape. When cutting tool 10 has a cylindrical shape, the tooth height must be sufficiently high, and the gullet sufficiently short to allow each tooth to make a cut into the workpiece, while preventing the base surface 14 from contracting and rubbing against the workpiece. Of course, cutting tool 10 may be of any shape or construction. For example, cutting tool 10 may be designed with a planar surface, such as a flat file, and may be designed to be used in a reciprocating, rotating or oscillating motion or combinations thereof.

In attaching teeth 16 to base surface 14 of cutting tool 10, the teeth are preferably individually molded separate from the base surface and subsequently brazed and affixed to the tool base surface.

Base surface 14 may also be comprised of numerous segments 52, which may be individually attached to the base body, as indicated by the dashed lines in FIG. 1. Each segment would typically have at least one tooth 16 affixed to it. In this manner, should tooth 16 become damaged, the corresponding segment could be removed, and a new segment attached in its place. The base surface segments can be attached in any conventional manner, such as by bolting or screwing the segment to the base body.

The foregoing is a complete description of preferred embodiments of the invention. Various changes may be made without departing from the spirit and scope of the present invention. The invention, therefore, should be limited only as set forth in the claims.

What is claimed is:

1. A multiple toothed cutting tool having a forward stroke direction, comprising:

a base body having a base surface; and a plurality of teeth attached to said base surface and arranged in a plurality of rows each oriented generally perpendicularly to said forward stroke direction, each said tooth having:

a leading face extending generally perpendicularly from the base surface and being arranged at an angle relative to said forward stroke direction;

a corresponding, similarly shaped trailing face relative to said forward stroke direction; and at least one cutting surface extending perpendicular to and between said leading face and said trailing face and having a generally linear crest having a length extending between said leading and trailing faces and situated at a distance from said base surface, each said leading face forming a piercing corner with said crest, wherein said leading face of each said tooth of at least one said row is oriented at an acute angle relative to the forward stroke direction, said at least one said row being adjacent to at least one alternating row, said leading face of each said tooth of said at least one said alternating row being oriented at an obtuse angle relative to said forward stroke direction.

2. A cutting tool as defined in claim 1, wherein each said tooth is symmetrical and said cutting tool is operational in a direction opposite to said forward stroke direction such that said trailing face can function as a leading face, and said leading face can function as a trailing face.

3. A cutting tool as defined in claim 1, wherein said teeth are individually molded and fused to said base member.

4. A cutting tool as defined in claim 1, wherein said base surface is cylindrical and wherein said forward stroke direction is perpendicular to a central axis of said cylindrical base surface.

5. A cutting tool as defined in claim 1, wherein said leading face and said cutting surface form a shearing edge therebetween extending from said piercing corner to said base.

6. A cutting tool as defined in claim 1, wherein said angle is between about 15 to about 90 degrees.

7. A cutting tool as defined in claim 1, wherein said angle is about 45 degrees.

8. A cutting tool as defined in claim 1, wherein each said leading face has a rake angle of approximately zero degrees.

9. A cutting tool as defined in claim 1, wherein each said trailing face has a rake angle of approximately zero degrees.

10. A cutting tool as defined in claim 1, wherein said distance represents a tooth height; and further wherein the tooth heights of each said tooth are essentially equal.

11. A cutting tool as defined in claim 10, wherein said tooth height is about equal to or less than the crest length.

12. A cutting tool as defined in claim 1, wherein said acute angle is between about 15 to about 90 degrees.

13. A cutting tool as defined in claim 1, wherein said acute angle is about 45 degrees.

14. A cutting tool as defined in claim 1, wherein said obtuse angle is between about 105 to about 165 degrees.

15. A cutting tool as defined in claim 1, wherein said obtuse angle is generally about 135 degrees.

16. A cutting tool as defined in claim 1, wherein said at least one said row and said at least one said alternating row are alternated in pairs, such that said leading faces of two adjacent rows form said obtuse angles and said leading faces of two subsequent adjacent rows form said acute angles.

17. A multiple toothed cutting tool having a forward stroke direction, comprising: and a base body having a base surface; and a plurality of teeth attached to said base surface arranged in a plurality of rows each oriented generally perpendicularly to said forward stroke direction, each said tooth being separated from an adjacent tooth by a space, and each said tooth having:

a leading face extending generally perpendicularly from the base surface and being arranged at an angle relative to said forward stroke direction;

a corresponding, similarly shaped trailing face relative to said forward stroke direction; and at least one cutting surface extending perpendicular to and between said leading face and said trailing face and having a generally linear crest having a length extending between said leading and trailing faces and situated at a distance from said base surface, each said leading face forming a piercing corner with said crest, wherein said leading face of each said tooth of at least one said row is oriented at an acute angle relative to the forward stroke direction.

18. A cutting tool as defined in claim 18, wherein each space is about equal to or greater than the crest length.

19. A multiple toothed cutting tool having a forward stroke direction, comprising:

a base body having a base surface; and a plurality of teeth attached to said base surface, each said tooth having:

a leading face extending generally perpendicularly from the base surface and being arranged at an angle relative to said forward stroke direction;

a corresponding similarly shaped trailing face relative to said forward stroke direction; and at least one cutting surface extending perpendicular to and between said leading face and said trailing face and having a generally linear crest having a length extending between said leading and trailing faces and situated at a distance from said base surface, each said leading face forming a piercing corner with said crest, wherein said teeth are arranged in a plurality of rows each oriented generally perpendicularly to said forward stroke direction, said teeth of any selected said row being offset relative to the teeth of an adjacent row as viewed parallel to said forward stroke direction, whereby a swath sheared in a work piece by said teeth of said adjacent row is located between swaths sheared by the teeth of said selected row, and wherein said leading face of each said tooth of at least one said row is oriented at an acute angle relative to the forward stroke direction.

20. A multiple toothed cutting tool having a forward stroke direction, comprising:

a base body having a base surface; and a plurality of teeth attached to said base surface, each said tooth having:

a leading face extending generally perpendicularly from the base surface and being arranged at an angle relative to said forward stroke direction;

a corresponding, similarly shaded trailing face relative to said forward stroke direction; and at least one cutting surface extending perpendicular to and between said leading face and said trailing face and having a generally linear crest having a length extending between said leading and trailing faces and situated at a distance from said base surface, each said leading face forming a piercing corner with said crest, wherein said teeth are arranged in a plurality of rows each oriented generally perpendicularly to said forward stroke direction, said teeth of any selected row being separated from the teeth of an adjacent row by a gullet, and said leading face of each said tooth of at least one said row being oriented at an acute angle relative to the forward stroke direction.

21. A cutting tool as defined in claim 20, wherein said gullet has a length being about equal to or greater than said crest length.

22. A multiple toothed cutting tool having a forward stroke direction, comprising:

a base body having a base surface; and a plurality of teeth attached to said base surface and arranged in a plurality of rows each oriented generally perpendicularly to said forward stroke direction, each said tooth having:

a leading face extending generally perpendicularly from the base surface and being arranged at an angle relative to said forward stroke direction;

a corresponding, similarly shaped trailing face relative to said forward stroke direction; and at least one cutting surface extending perpendicular to and between said leading face and said trailing face and having a generally linear crest having a length extending between said leading and trailing faces and situated at a distance from said base surface, each said leading face forming a piercing corner with said crest, wherein said leading face of each said tooth of at least one said row is oriented at an acute angle relative to the forward stroke direction, and each tooth of said at least one said row is similarly shaped and arranged as any adjacent tooth of said at least one said row.

23. A cutting tool as defined in claim 1, wherein each said tooth has a cross-section taken perpendicular to said at least one cutting surface and corresponding in shape to said leading face.

24. A cutting tool as defined in claim 23, wherein said cross-section has a triangular shape.

25. A cutting tool as defined in claim 24, wherein said triangular shape is an isosceles triangle; and further wherein the two equal angles are formed at the base.

26. A cutting tool as defined in claim 24, wherein said triangular shape is a right-angled triangle, the right angle being formed between the cutting surface and the base.

27. A cutting tool as defined in claim 24, wherein said has an upper edge relative to said base surface, one of said angles of said triangular shape forming said upper edge and being between about 30 to about 90 degrees.

28. A cutting tool as defined in claim 27, wherein said angle forming said upper edge is generally about 45 degrees.

29. A multiple toothed cutting tool having a forward stroke direction, comprising:

a base body having a base surface; and a plurality of teeth attached to said base surface, each said tooth having:

a leading face extending generally perpendicularly from the base surface and being arranged at an angle relative to said forward stroke direction;

a corresponding, similarly shaped trailing face relative to said forward stroke direction; and at least one concave cutting surface extending perpendicular to and between said leading face and said trailing face and having a generally linear crest having a length extending between said leading and trailing faces and situated at a distance from said base surface, each said leading face forming a piercing corner with said crest, wherein each said tooth has a cross-section taken perpendicular to said at least one cutting surface and corresponding in shape to said leading face, said cross-section having an arcuate edge corresponding to said cutting surface.

30. A cutting tool as defined in claim 1, wherein said crest has an upper edge relative to said base surface.

31. A cutting tool as defined in claim 30, wherein said upper edge forms a planar surface parallel to said base surface.

32. A cutting tool as defined in claim 30, wherein said upper edge is serrated.

33. A multiple toothed cutting tool having a forward stroke direction, comprising:

a base body having a base surface; and a plurality of teeth attached to said base surface, each said tooth having:

a leading face extending generally perpendicularly from the base surface and being arranged at an angle relative to said forward stroke direction;

a corresponding, similarly shaped trailing face relative to said forward stroke direction; and at least one cutting surface extending perpendicular to and between said leading face and said trailing face and having a generally linear crest having an convex upper edge relative to said base surface, said crest further having a length extending between said leading and trailing faces and situated at a distance from said base surface, each said leading face forming a piercing corner with said crest.

34. A cutting tool as defined in claim 30, wherein said upper edge comprises partially exposed bonded grits having up to a diamond-like hardness.

35. A cutting tool as defined in claim 34, wherein said grits are bonded to said tooth up to said crest in a brazed matrix whereby about one-half of each grit at said upper edge is exposed.

36. A multiple toothed cutting tool having a forward stroke direction, comprising:

a base body having a base surface; and a plurality of teeth attached to said base surface and arranged in a plurality of parallel rows, each said row being oriented at an angle between about 45 to about 90 degrees relative to said forward stroke direction, each said tooth having:

a leading face extending generally perpendicularly from the base surface and being arranged at an angle relative to said forward stroke direction;

a corresponding, similarly shaped trailing face relative to said forward stroke direction; and at least one cutting surface extending perpendicular to and between said leading face and said trailing face and having generally linear crest having a length extending between said leading and trailing faces and situated at a distance from said base surface, each said leading face forming a piercing corner with said crest.

37. A cutting tool as defined in claim 1, wherein said crest length is up to about one-eighth inch.

38. A cutting tool as defined in claim 1, wherein each tooth crest is essentially parallel to the base surface.

39. A multiple toothed cutting tool having a forward stroke direction, comprising:

a base body having a base surface; and a plurality of teeth attached to said base surface, each said tooth having a base width relative to said base surface and each said tooth comprising;

a leading face extending generally perpendicularly from the base surface and being arranged at an angle relative to said forward stroke direction;

a corresponding, similarly shaped trailing face relative to said forward stroke direction; and at least one cutting surface extending perpendicular to and between said leading face and said trailing face and having a generally linear crest having a length greater than said base width extending between said leading and trailing faces and situated at a distance from said base surface, each said leading face forming a piercing corner with said crest.

40. A multiple toothed cutting tool having a forward a stroke direction, comprising:

a base body having a base surface comprising plural segments individually attached to said base body; and a plurality of teeth attached to said base surface, each said segment including at least one of said teeth, each said tooth having:

a leading face extending generally perpendicularly from the base surface and being arranged at an angle relative to said forward stroke direction;

a corresponding, similarly shaped trailing face relative to said forward stroke direction; and at least one cutting surface extending perpendicular to and between said leading face and said trailing face and having a generally linear crest extending between said leading and trailing faces and situated at a distance from said base surface, each said leading face forming a piercing corner with said crest.

41. A multiple toothed cutting tool having a forward stroke direction, comprising:

a base body having a planar base surface; and.

a plurality of teeth attached to said base surface, each said tooth having:

a leading face extending generally perpendicularly from the base surface and being arranged at an angle relative to said forward stroke direction;

a corresponding, similarly shaped trailing face relative to said forward stroke direction; and at least one cutting surface extending perpendicular to and between said leading face and said trailing face and having a generally linear crest extending between said leading and trailing faces and situated at a distance from said base surface, each said leading face forming a piercing corner with said crest.

42. A cutting tool as defined in claim 1, wherein each said tooth is separated from an adjacent tooth by a space.

43. A cutting tool as defined in claim 42, wherein each space is about equal to or greater than the crest length.

44. A cutting tool as defined in claim 1, wherein said teeth of any selected said row are offset relative to the teeth of an adjacent row as viewed parallel to said forward stroke direction, whereby a swath sheared in a work piece by said teeth of said adjacent row is located between swaths sheared by the teeth of said selected row.

45. A cutting tool as defined in claim 1, wherein said teeth of any selected row are separated from the teeth of an adjacent row by a gullet.

46. A cutting tool as defined in claim 45, wherein said gullet has a length being about equal to or greater than said crest length.

47. A cutting tool as defined in claim 1, wherein each tooth of said at least one said row is similarly shaped and arranged as any adjacent tooth of said at least one said row.

48. A cutting tool as defined in claim 23, wherein said cutting surface is concave; and further wherein said cross-section has an arcuate edge corresponding to said cutting surface.

49. A cutting tool as defined in claim 30, wherein said upper edge is convex relative to said base surface.

50. A cutting tool as defined in claim 1, wherein each said tooth has a base width relative to said base surface; and further wherein said crest length is greater than said base width.

51. A cutting tool as defined in claim 1, said base surface further comprising plural segments individually attached to said base body, wherein each said segment includes at least one of said teeth.

52. A cutting tool as defined in claim 1, wherein said base surface is planar.

53. A cutting tool as defined in claim 17, wherein each said tooth is symmetrical and said cutting tool is operational in a direction opposite to said forward stroke direction such that said trailing face can function as a leading face, and said leading face can function as a trailing face.

54. A cutting tool as defined in claim 17, wherein said teeth are individually molded and fused to said base member.

55. A cutting tool as defined in claim 17, wherein said base surface is cylindrical and wherein said forward stroke direction is perpendicular to a central axis of said cylindrical base surface.

56. A cutting tool as defined in claim 17, wherein said leading face and said cutting surface form a shearing edge therebetween extending from said piercing corner to said base.

57. A cutting tool as defined in claim 17, wherein said angle is between about 15 to about 90 degrees.

58. A cutting tool as defined in claim 17, wherein each said leading face has a rake angle of approximately zero degrees.

59. A cutting tool as defined in claim 17, wherein each said trailing face has a rake angle of approximately zero degrees.

60. A cutting tool as defined in claim 17, wherein said distance represents a tooth height; and further wherein the tooth heights of each said tooth are essentially equal.

61. A cutting tool as defined in claim 60, wherein said tooth height is about equal to or less than the crest length.

62. A cutting tool as defined in claim 17, wherein said acute angle is between about 15 to about 90 degrees.

63. A cutting tool as defined in claim 17, wherein said at least one said row is adjacent to at least one alternating row, said leading face of each said tooth of said at least one said alternating row being oriented at an obtuse angle relative to said forward stroke direction, said obtuse angle being between about 105 to about 165 degrees.

64. A cutting tool as defined in claim 17, wherein said at least one said row is adjacent to at least one alternating row, said leading face of each said tooth of said at least one said alternating row being oriented at an obtuse angle relative to said forward stroke direction, said at least one said row and said at least one said alternating row being alternated in pairs, such that said leading faces of two adjacent rows form said obtuse angles and said leading faces of two subsequent adjacent rows form said acute angles.

65. A cutting tool as defined in claim 17, wherein said teeth of any selected said row are offset relative to the teeth of an adjacent row as viewed parallel to said forward stroke direction, whereby a swath sheared in a work piece by said teeth of said adjacent row is located between swaths sheared by the teeth of said selected row.

66. A cutting tool as defined in claim 17, wherein each tooth of said at least one said row is similarly shaped and arranged as any adjacent tooth of said at least one said row.

67. A cutting tool as defined in claim 17, wherein each said tooth has a cross-section taken perpendicular to said at least one cutting surface and corresponding in shape to said leading face.

68. A cutting tool as defined in claim 67, wherein said cross-section has a triangular shape.

69. A cutting tool as defined in claim 68, wherein said triangular shape is an isosceles triangle; and further wherein the two equal angles are formed at the base.

70. A cutting tool as defined in claim 68, wherein said triangular shape is a right-angled triangle, the right angle being formed between the cutting surface and the base.

71. A cutting tool as defined in claim 68, wherein said crest has an upper edge relative to said base surface, one of said angles of said triangular shape forming said upper edge and being between about 30 to about 90 degrees.

72. A cutting tool as defined in claim 67, wherein said cutting surface is concave; and further wherein said cross-section has an arcuate edge corresponding to said cutting surface.

73. A cutting tool as defined in claim 17, wherein said crest has an upper edge relative to said base surface.

74. A cutting tool as defined in claim 73, wherein said upper edge forms a planar surface parallel to said base surface.

75. A cutting tool as defined in claim 73, wherein said upper edge is serrated.

76. A cutting tool as defined in claim 73, wherein said upper edge is convex relative to said base surface.

77. A cutting tool as defined in claim 73, wherein said upper edge comprises partially exposed bonded grits having up to a diamond-like hardness.

78. A cutting tool as defined in claim 77, wherein said grits are bonded to said tooth up to said crest in a brazed matrix whereby about one-half of each grit at said upper edge is exposed.

79. A cutting tool as defined in claim 17, wherein said crest length is up to about one-eighth inch.

80. A cutting tool as defined in claim 17, wherein each tooth crest is essentially parallel to the base surface.

81. A cutting tool as defined in claim 17, wherein each said tooth has a base width relative to said base surface; and further wherein said crest length is greater than said base width.

82. A cutting tool as defined in claim 17, said base surface further comprising plural segments individually attached to said base body, wherein each said segment includes at least one of said teeth.

83. A cutting tool as defined in claim 17, wherein said base surface is planar.

84. A cutting tool as defined in claim 19, wherein each said tooth is symmetrical and said cutting tool is operational in a direction opposite to said forward stroke direction such that said trailing face can function as a leading face, and said leading face can function as a trailing face.

85. A cutting tool as defined in claim 19, wherein said teeth are individually molded and fused to said base member.

86. A cutting tool as defined in claim 19, wherein said base surface is cylindrical and wherein said forward stroke direction is perpendicular to a central axis of said cylindrical base surface.

87. A cutting tool as defined in claim 19, wherein said leading face and said cutting surface form a shearing edge therebetween extending from said piercing corner to said base.

88. A cutting tool as defined in claim 19, wherein said distance represents a tooth height; and further wherein the tooth heights of each said tooth are essentially equal.

89. A cutting tool as defined in claim 19, wherein said at least one said row is adjacent to at least one alternating row, said leading face of each said tooth of said at least one said alternating row being oriented at an obtuse angle relative to said forward stroke direction, said obtuse angle being between about 105 to about 165 degrees.

90. A cutting tool as defined in claim 19, wherein said at least one said row is adjacent to at least one alternating row, said leading face of each said tooth of said at least one said alternating row being oriented at an obtuse angle relative to said forward stroke direction, said at least one said row and said at least one said alternating row being alternated in pairs, such that said leading faces of two adjacent rows form said obtuse angles and said leading faces of two subsequent adjacent rows form said acute angles.

91. A cutting tool as defined in claim 19, wherein each tooth of said at least one said row is similarly shaped and arranged as any adjacent tooth of said at least one said row.

92. A cutting tool as defined in claim 19, wherein each said tooth has a cross-section taken perpendicular to said at least one cutting surface and corresponding in shape to said leading face.

93. A cutting tool as defined in claim 19, wherein said crest has an upper edge relative to said base surface comprising partially exposed bonded grits having up to a diamond-like hardness.

94. A cutting tool as defined in claim 19, said base surface further comprising plural segments individually attached to said base body, wherein each said segment includes at least one of said teeth.

95. A cutting tool as defined in claim 22, wherein each said tooth is symmetrical and said cutting tool is operational in a direction opposite to said forward stroke direction such that said trailing face can function as a leading face, and said leading face can function as a trailing face.

96. A cutting tool as defined in claim 22, wherein said teeth are individually molded and fused to said base member.

97. A cutting tool as defined in claim 22, wherein said base surface is cylindrical and wherein said forward stroke direction is perpendicular to a central axis of said cylindrical base surface.

98. A cutting tool as defined in claim 22, wherein said leading face and said cutting surface form a shearing edge therebetween extending from said piercing corner to said base.

99. A cutting tool as defined in claim 22, wherein said distance represents a tooth height; and further wherein the tooth heights of each said tooth are essentially equal.

100. A cutting tool as defined in claim 22, wherein said at least one said row is adjacent to at least one alternating row, said leading face of each said tooth of said at least one said alternating row being oriented at an obtuse angle relative to said forward stroke direction, said obtuse angle being between about 105 to about 165 degrees.

101. A cutting tool as defined in claim 22, wherein said at least one said row is adjacent to at least one alternating row, said leading face of each said tooth of said at least one said alternating row being oriented at an obtuse angle relative to said forward stroke direction, said at least one said row and said at least one said alternating row being alternated in pairs, such that said leading faces of two adjacent rows form said obtuse angles and said leading faces of two subsequent adjacent rows form said acute angles.

102. A cutting tool as defined in claim 22, wherein each said tooth has a cross-section taken perpendicular to said at least one cutting surface and corresponding in shape to said leading face.

103. A cutting tool as defined in claim 22, wherein said crest has an upper edge relative to said base surface comprising partially exposed bonded grits having up to a diamond-like hardness.

104. A cutting tool as defined in claim 22, said base surface further comprising plural segments individually attached to said base body, wherein each said segment includes at least one of said teeth.

105. A cutting tool as defined in claim 36, wherein each said tooth is symmetrical and said cutting tool is operational in a direction opposite to said forward stroke direction such that said trailing face can function as a leading face, and said leading face can function as a trailing face.

106. A cutting tool as defined in claim 36, wherein said teeth are individually molded and fused to said base member.

107. A cutting tool as defined in claim 36, wherein said leading face and said cutting surface form a shearing edge therebetween extending from said piercing corner to said base.

108. A cutting tool as defined in claim 36, wherein said distance represents a tooth height; and further wherein the tooth heights of each said tooth are essentially equal.

109. A cutting tool as defined in claim 36, wherein said teeth of any selected said row are offset relative to the teeth of an adjacent row as viewed parallel to said forward stroke direction, whereby a swath sheared in a work piece by said teeth of said adjacent row is located between swaths sheared by the teeth of said selected row.

110. A cutting tool as defined in claim 36, wherein each tooth of said at least one said row is similarly shaped and arranged as any adjacent tooth of said at least one said row.

111. A cutting tool as defined in claim 36, wherein each said tooth has a cross-section taken perpendicular to said at least one cutting surface and corresponding in shape to said leading face.

112. A cutting tool as defined in claim 36, wherein said crest has an upper edge relative to said base surface comprising partially exposed bonded grits having up to a diamond-like hardness.

113. A cutting tool as defined in claim 36, said base surface further comprising plural segments individually attached to said base body, wherein each said segment includes at least one of said teeth.

114. A cutting tool as defined in claim 39, wherein each said tooth is symmetrical and said cutting tool is operational in a direction opposite to said forward stroke direction such that said trailing face can function as a leading face, and said leading face can function as a trailing face.

115. A cutting tool as defined in claim 39, wherein said teeth are individually molded and fused to said base member.

116. A cutting tool as defined in claim 39, wherein said leading face and said cutting surface form a shearing edge therebetween extending from said piercing corner to said base.

117. A cutting tool as defined in claim 39, wherein said distance represents a tooth height; and further wherein the tooth heights of each said tooth are essentially equal.

118. A cutting tool as defined in claim 39, wherein said teeth are arranged in a plurality of rows, each said row being oriented generally perpendicularly to said forward stroke direction and said leading face of each said tooth of at least one said row being oriented at an acute angle relative to said forward stroke direction.

119. A cutting tool as defined in claim 39, wherein each said tooth has a cross-section taken perpendicular to said at least one cutting surface and corresponding in shape to said leading face.

120. A cutting tool as defined in claim 39, wherein said teeth are arranged in a plurality of parallel rows, each said row being oriented at an angle between about 45 to about 90 degrees relative to said forward stroke direction.

121. A cutting tool as defined in claim 40, wherein each said tooth is symmetrical and said cutting tool is operational in a direction opposite to said forward stroke direction such that said trailing face can function as a leading face, and said leading face can function as a trailing face.

122. A cutting tool as defined in claim 40, wherein said leading face and said cutting surface form a shearing edge therebetween extending from said piercing corner to said base.

123. A cutting tool as defined in claim 40, wherein said distance represents a tooth height; and further wherein the tooth heights of each said tooth are essentially equal.

124. A cutting tool as defined in claim 40, wherein said teeth are arranged in a plurality of rows, each said row being oriented generally perpendicularly to said forward stroke direction and said leading face of each said tooth of at least one said row being oriented at an acute angle relative to said forward stroke direction.

125. A cutting tool as defined in claim 40, wherein each said tooth has a cross-section taken perpendicular to said at least one cutting surface and corresponding in shape to said leading face.

126. A cutting tool as defined in claim 40, wherein each said tooth is symmetrical and said cutting tool is operational in a direction opposite to said forward stroke direction such that said trailing face can function as a leading face, and said leading face can function as a trailing face.

127. A cutting tool as defined in claim 41, wherein said teeth are individually molded and fused to said base member.

128. A cutting tool as defined in claim 41, wherein said leading face and said cutting surface form a shearing edge therebetween extending from said piercing corner to said base.

129. A cutting tool as defined in claim 41, wherein said distance represents a tooth height; and further wherein the tooth heights of each said tooth are essentially equal.

130. A cutting tool as defined in claim 41, wherein said teeth are arranged in a plurality of rows, each said row being oriented generally perpendicularly to said forward stroke direction and said leading face of each said tooth of at least one said row being oriented at an acute angle relative to said forward stroke direction.

131. A cutting tool as defined in claim 41, wherein each said tooth has a cross-section taken perpendicular to said at least one cutting surface and corresponding in shape to said leading face.

132. A cutting tool as defined in claim 41, wherein said teeth are arranged in a plurality of parallel rows, each said row being oriented at an angle between about 45 to about 90 degrees relative to said forward stroke direction.

* * * * *